US012214947B2

(12) United States Patent
Connolly

(10) Patent No.: US 12,214,947 B2
(45) Date of Patent: Feb. 4, 2025

(54) APPARATUS FOR INTERACTIVE MULTI-CHAMBER POUCH

(71) Applicant: Sean Michel Connolly, Paterson, NJ (US)

(72) Inventor: Sean Michel Connolly, Paterson, NJ (US)

( * ) Notice: Subject to any disclaimer, the term of this patent is extended or adjusted under 35 U.S.C. 154(b) by 156 days.

(21) Appl. No.: 17/965,597

(22) Filed: Oct. 13, 2022

(65) Prior Publication Data

US 2024/0124205 A1 Apr. 18, 2024

(51) Int. Cl.

*B65D 75/32* (2006.01)
*B65D 75/00* (2006.01)
*B65D 75/52* (2006.01)

(52) U.S. Cl.

CPC ..... *B65D 75/323* (2013.01); *B65D 75/008* (2013.01); *B65D 75/52* (2013.01)

(58) Field of Classification Search

CPC ..... B65D 75/323; B65D 75/008; B65D 75/52
USPC ..... 383/104, 38, 202
See application file for complete search history.

(56) References Cited

U.S. PATENT DOCUMENTS 3,171,581 A * 3/1965 Kugler ..... B65D 75/5866 426/115
3,304,977 A * 2/1967 Hammons ..... G01N 33/4905 206/569
4,256,256 A * 3/1981 Meyers ..... B65D 31/12 53/550
5,884,758 A * 3/1999 Sigouin ..... B65B 61/205 206/217
11,930,943 B2 * 3/2024 Connolly ..... G09B 7/06
2006/0027478 A1 * 2/2006 Kaufman ..... B65D 33/004 383/106
2008/0107781 A1 * 5/2008 Carroll ..... B65D 31/12 426/106
2014/0312063 A1 * 10/2014 Owensby ..... B65D 75/008 222/105
2018/0244434 A1 * 8/2018 Asikainen ..... B65D 33/002
2023/0159215 A1 * 5/2023 Connolly ..... B65D 5/48026 229/120.02

FOREIGN PATENT DOCUMENTS

DE 3020052 A1 * 12/1981
DE 102019133514 A1 * 6/2021
JP 2011068367 A * 4/2011
KR 20130072358 A * 7/2013
WO WO-2016124881 A1 * 8/2016 ..... B65D 75/008

* cited by examiner

*Primary Examiner* — Jes F Pascua
(74) *Attorney, Agent, or Firm* — Erickson Law Group, PC

(57) ABSTRACT

An exemplary embodiment pouch includes a bottom wall and front and back panels that extend upwardly from the bottom wall. A plurality of chambers are internally defined in the pouch. The plurality of chambers includes a primary chamber and at least one secondary chamber. The primary chamber includes a primary opening, such that the primary chamber can be accessed by a user via the primary opening. Each secondary chamber individually includes a secondary opening, such that each secondary chamber can be individually accessed by a user via the specific secondary opening. As such, the user can access each chamber of the plurality of the chambers from the outside of the housing.

7 Claims, 8 Drawing Sheets

100
138
148a
162
132a
132
138b
138
132b
110
138a
166
164
120
162
134
150a
160
170
134a
142b
142
142
134b
126
142
142a

APPARATUS FOR INTERACTIVE MULTI-CHAMBER POUCH

BACKGROUND

Many individuals, such as children, enjoy juice or other beverage from a pouch. One popular drink pouch is the commercially available CAPRIS SUN drink pouch available from Capri Sun Gmbh Limited Liability Company, Fed. Rep. Germany, Rudolf-Wild-Strasse 86-98 Eppelheim, Fed. Rep. Germany, 69214. Other drink pouches include those described in U.S. Pat. No. 6,076,664 or 3,380,646, which are herein incorporated by reference to the extent they are not incompatible with the present disclosure.

These individuals, however, may not enjoy various school-related activities, such as homework or studying. Typically, younger individuals may not have a developed appreciation for their academic development or education. It is generally known that students who study will perform better than students who choose not to study. It is also generally known that students will retain information more easily if they are interested in the information. Many teachers and parents have tried to develop innovative and interesting ways to capture the attention of students and children, however, many methods are time-intensive or are simply ineffective.

Therefore, there is a defined need amongst the known art for a device that will stimulate students and children in a manner that will entice them to be more interested in learning. The device should utilize a system that provides a reward for a student that is able to correctly identify an answer to a question.

SUMMARY

The present invention provides a multi-chamber pouch. More specifically, the present invention provides a system with which a user can engage in a knowledge-testing activity while eating food or consuming liquids.

An exemplary embodiment pouch includes a bottom wall and front and back panels that extend upwardly from the bottom wall. A plurality of chambers are internally defined in the pouch. The plurality of chambers includes a primary chamber and at least one secondary chamber. The primary chamber includes a primary opening, such that the primary chamber can be accessed by a user via the primary opening. Each secondary chamber individually includes a secondary opening, such that each secondary chamber can be individually accessed by a user via the specific secondary opening. As such, the user can access each chamber of the plurality of the chambers from the outside of the housing.

A particular enhancement of the invention is the incorporation of an educational function into the pouch. A user is presented with a question, either displayed on the pouch or on a tag or packaging thereof, or on a mobile device. The user is also provided with multiple answers displayed in like manner as the question. The answers have indicia associated with each answer, such as A, B, C, D and the primary and secondary openings on the pouch have the same corresponding indicia A, B, C, D displayed adjacent to or on each opening. The indicia for the correct answer will be displayed adjacent to or on the primary opening while the incorrect answers will be displayed adjacent to, or on the secondary openings. Depending on the questions, the correct answer could be any of answer choices A, B, C, or D and the correct answer choice corresponds to the primary opening.

The primary and secondary openings are indistinguishable by a user from an outside of the pouch. If the user picks the correct answer and opens the opening associated with the same indicia as his or her answer, the user will be opening the primary opening and will gain access to the contents of the primary chamber. If the user selects an incorrect answer and opens the opening of the pouch having the same indicia as his or her answer, the user will open the secondary opening and will access the secondary chamber. According to the exemplary embodiment, the primary chamber holds the desired contents of the pouch while the secondary chamber is empty or contains a secondary fluid or material.

The disclosure provides a multi-chamber pouch with an educational function in that the primary chamber stores a desired liquid or solid material and the secondary chamber can be empty. The primary and secondary openings are indistinguishable to the consumer until opened from a closed state. The selection of the primary opening corresponds to a correct answer to a question displayed on, or associated with, the pouch.

Some of the exemplary embodiments described herein provide an efficient way of making or manufacturing a multi-chamber pouch that can be made from pure recyclable material and can be compatible towards being in compliance with the Aseptic filling system used by juice filling companies in order to preserve quality and promote longer shelf life.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION

Figure 1:
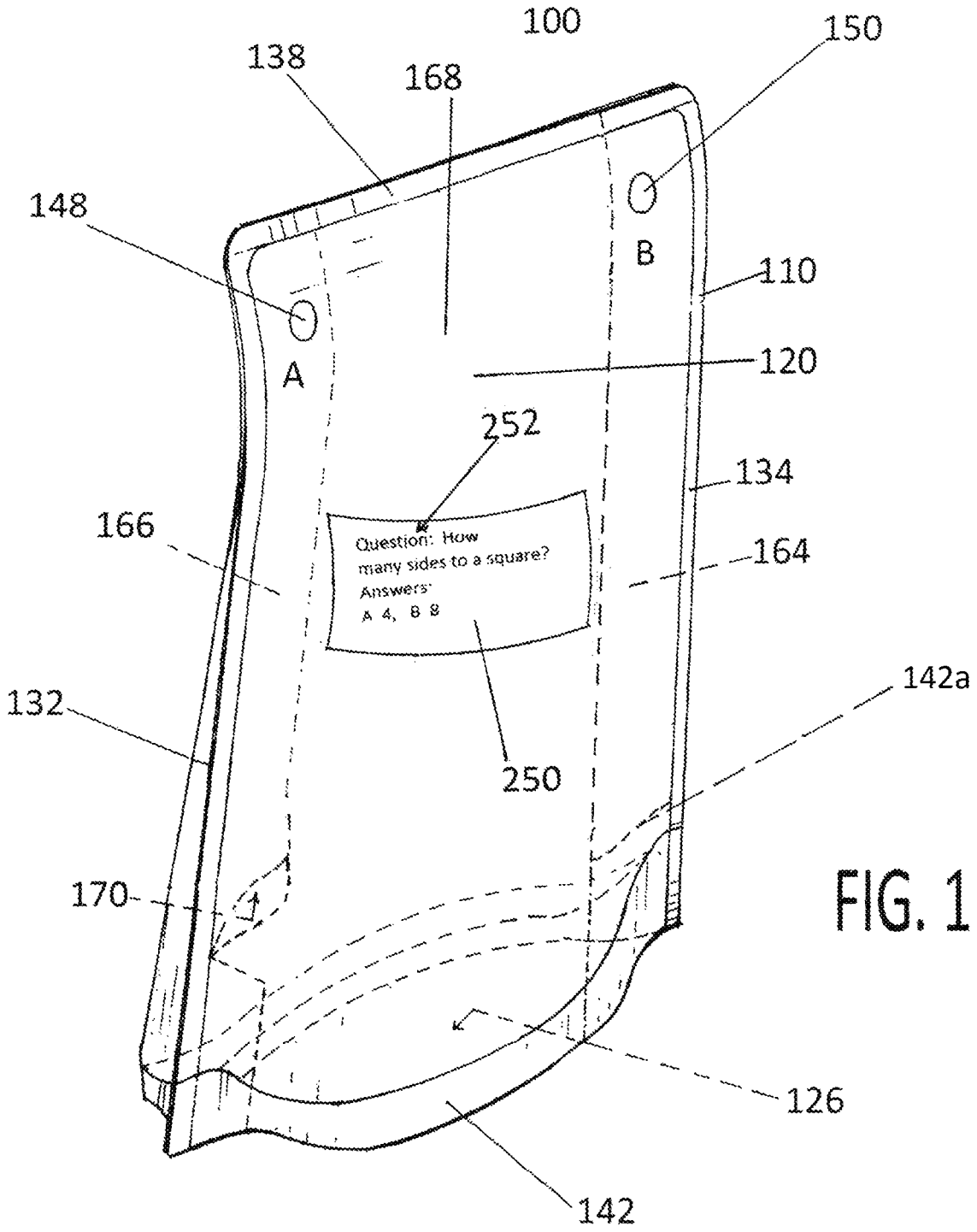
FIG. 1 is a front perspective view of an exemplary embodiment pouch of the present invention.
Figure 2:
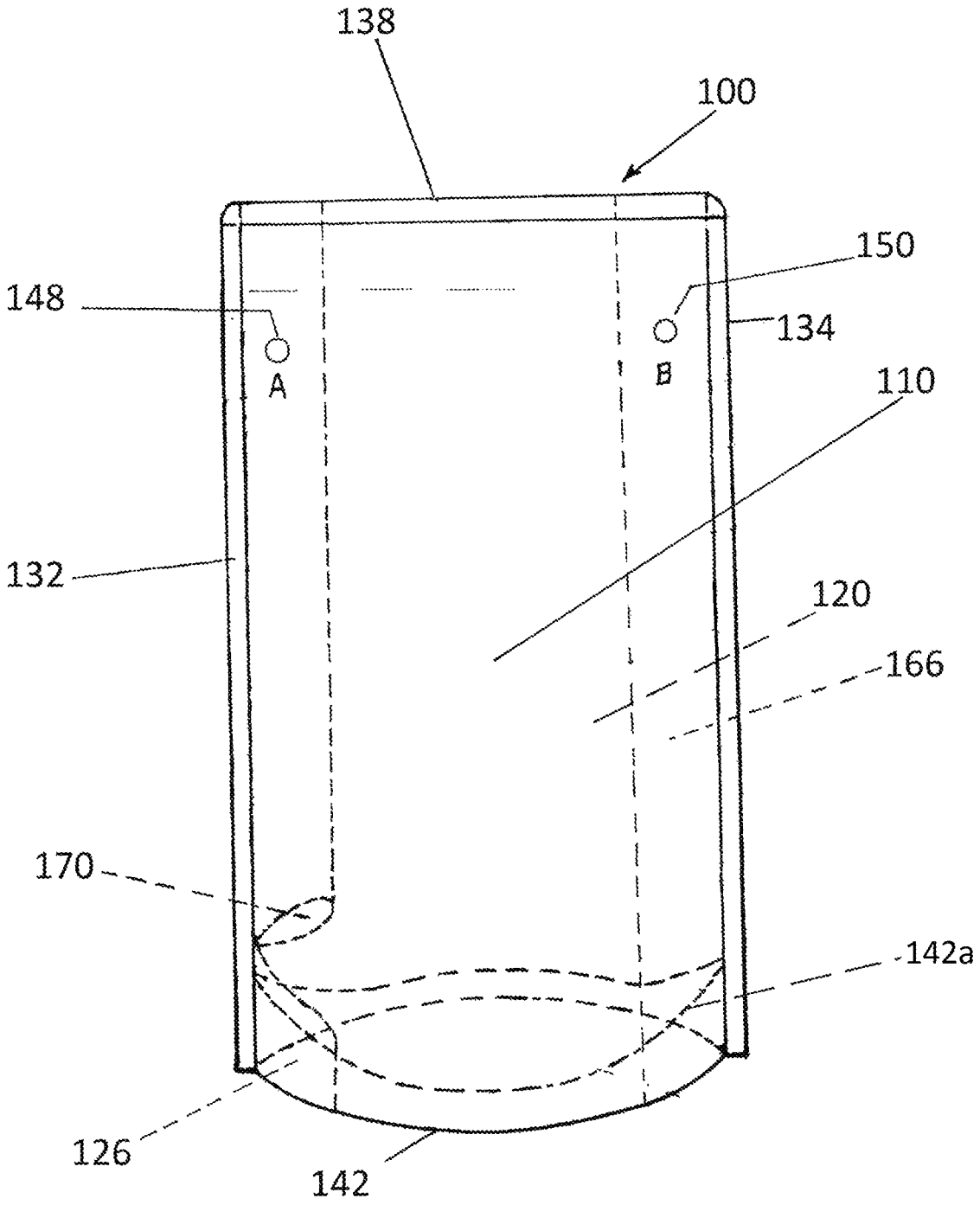
FIG. 2 is a front view of the pouch of FIG. 1.
Figure 4:
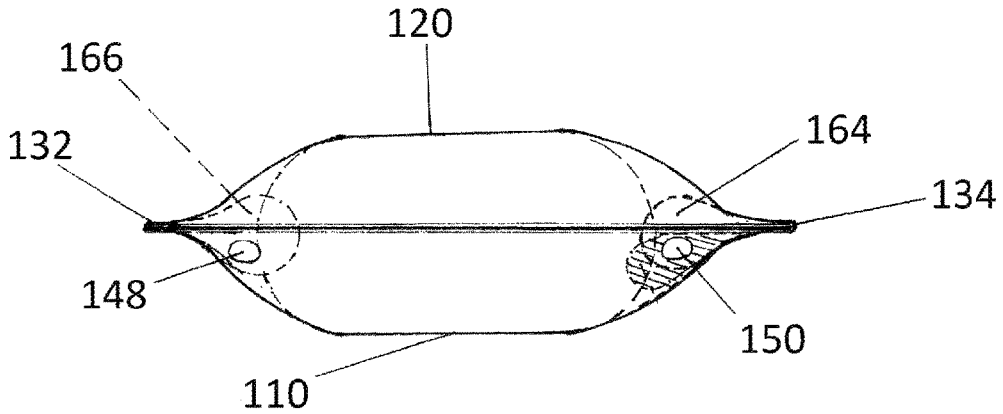
FIG. 4 is a plan view of the pouch shown in FIG. 1.
Figure 3:
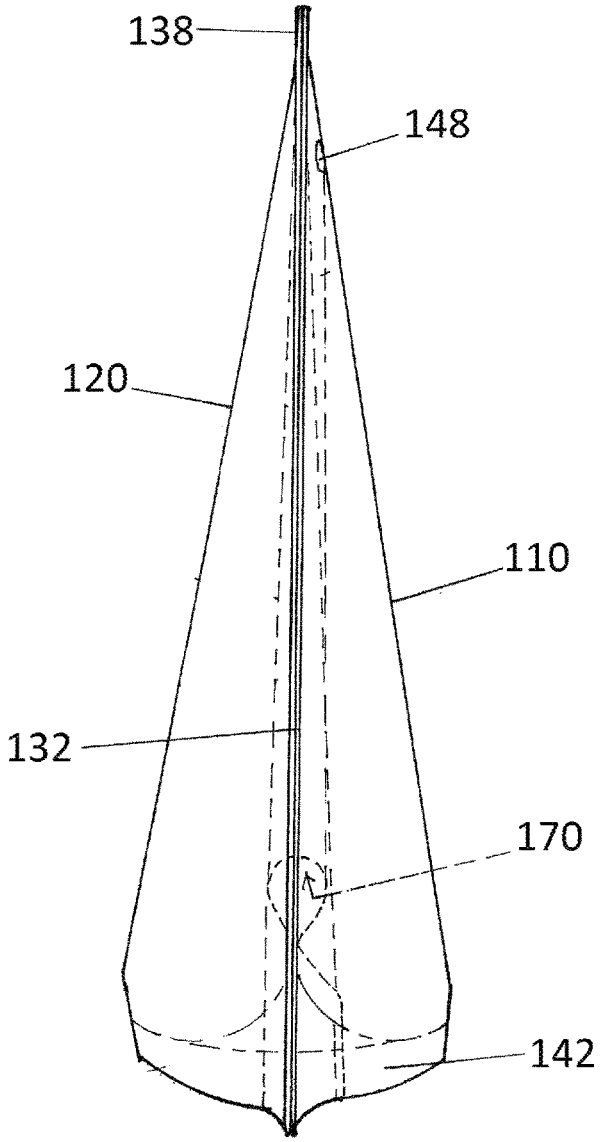
FIG. 3 is a left side view of the pouch of FIG. 1.

Reference is made herein to the attached drawings. Like reference numerals are used throughout the drawings to depict like or similar elements of the multi-chamber pouch. The figures are intended for representative purposes only and should not be considered to be limiting in any respect.

This application incorporates by reference U.S. Provisional application Ser. No. 62/833,160, filed Apr. 12, 2019; U.S. Provisional application Ser. No. 63/247,126, filed Sep.

22, 2021 and U.S. Non-provisional application Ser. No. 16/817,362 filed Mar. 12, 2020.

FIGS. 1-6 illustrates a pouch 100 which comprises a front panel 110, a back panel 120 and a floor panel 126. The front panel 110, the back panel 120 and the floor panel 126 may be of a multi-layer construction as is known for flexible pouches containing a beverage. The front panel and the back panel are sealed together along vertical seal bands 132, 134 and across a top seal band 138. The front and back panels 110, 120 are sealed along inside bottom bands, forming a continuous band 142 all around to the floor panel 126.

On the front panel, near the top, are two ports, a left front port 148 and a right front port 150. The ports 148, 150 are circular and can be areas having weakened perimeters that allow for a straw to be forcefully inserted into the pouch through the front panel.

Figure 5:
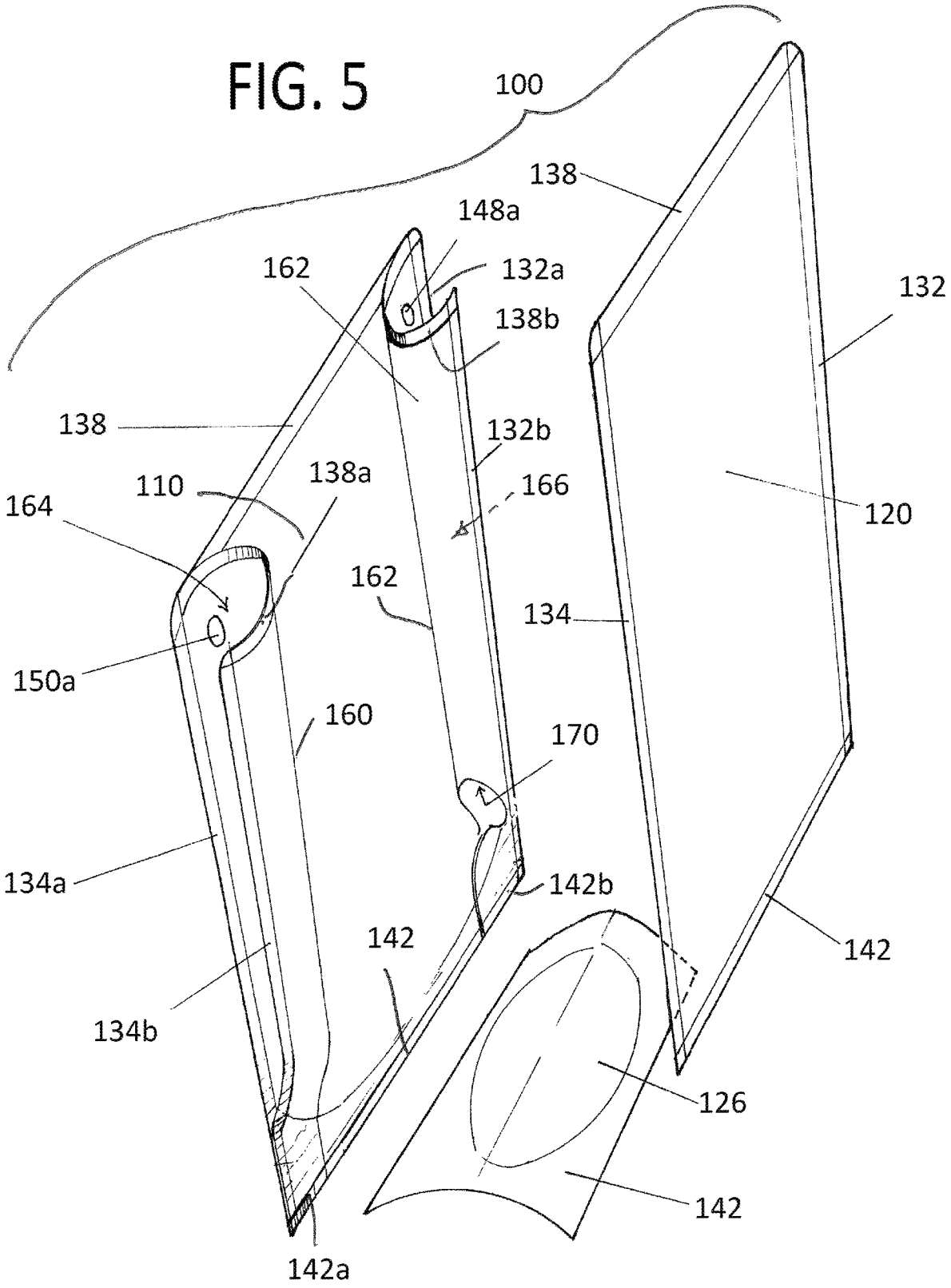
FIG. 5 is a rear exploded perspective view of the pouch of FIG. 1, before a front panel, a back panel, and a floor are sealed together.
Figure 6:
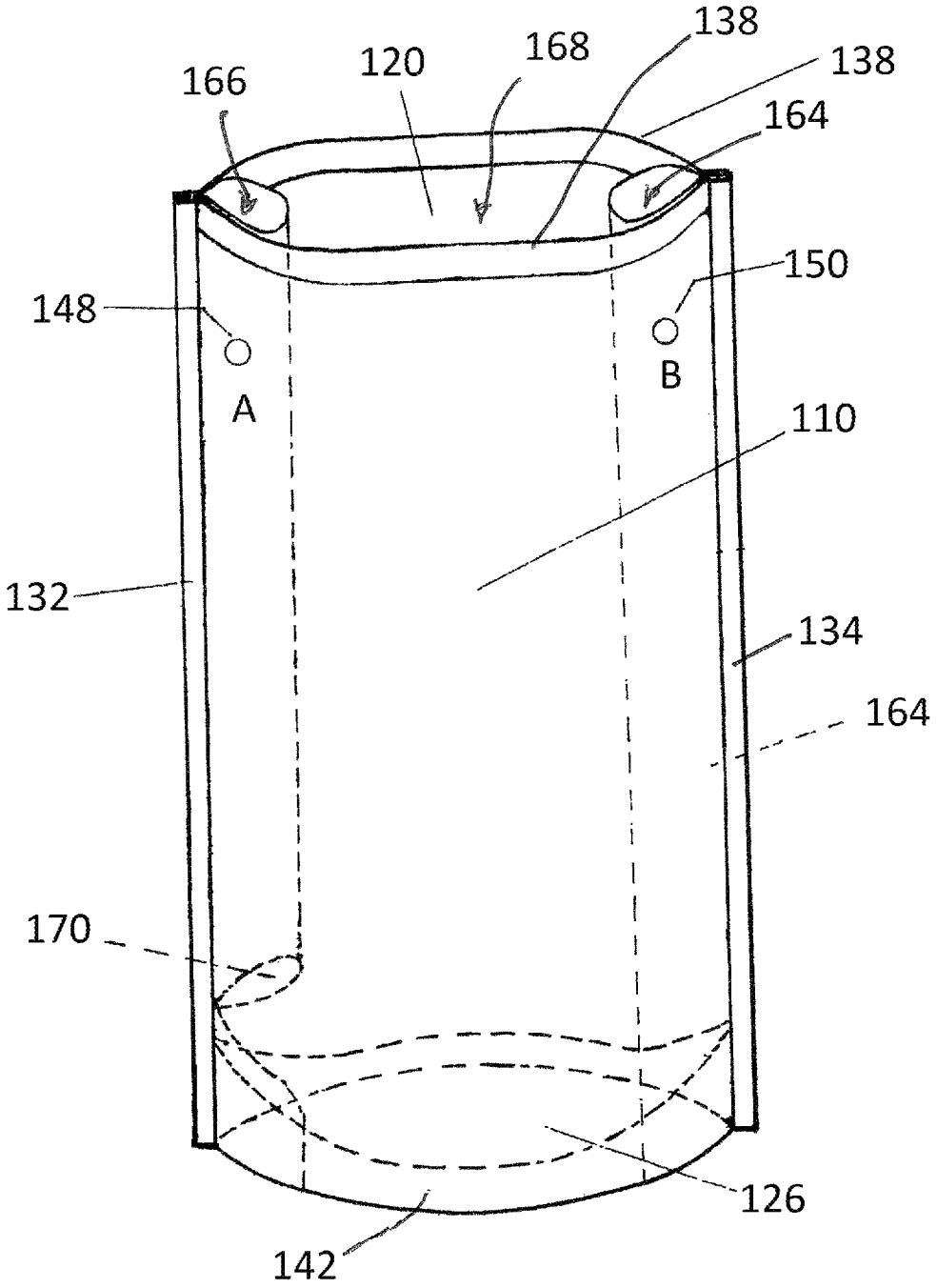
FIG. 6 is a front perspective view of the pouch of FIG. 5 with the front panel, the back panel, and the floor sealed, except for the top edge of the front and back panels.
Figure 8:
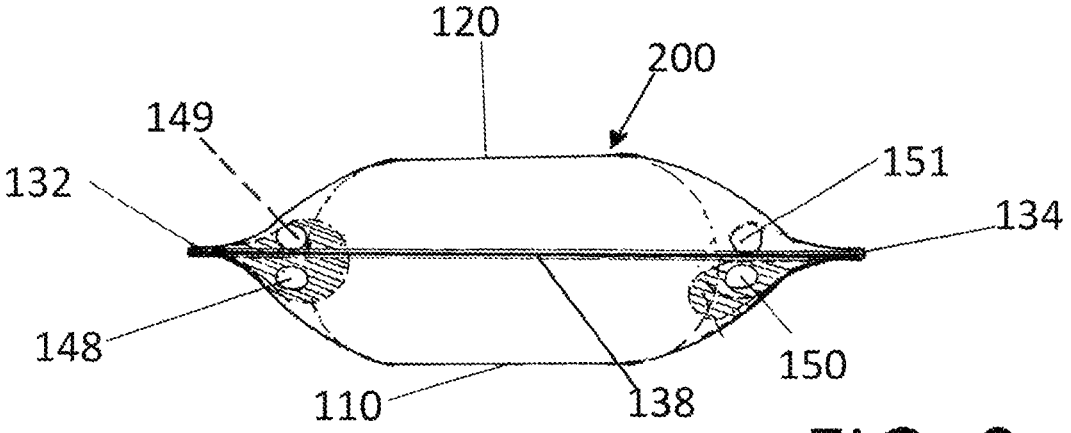
FIG. 8 is a plan view of the pouch shown in FIG. 7.
Figure 7:
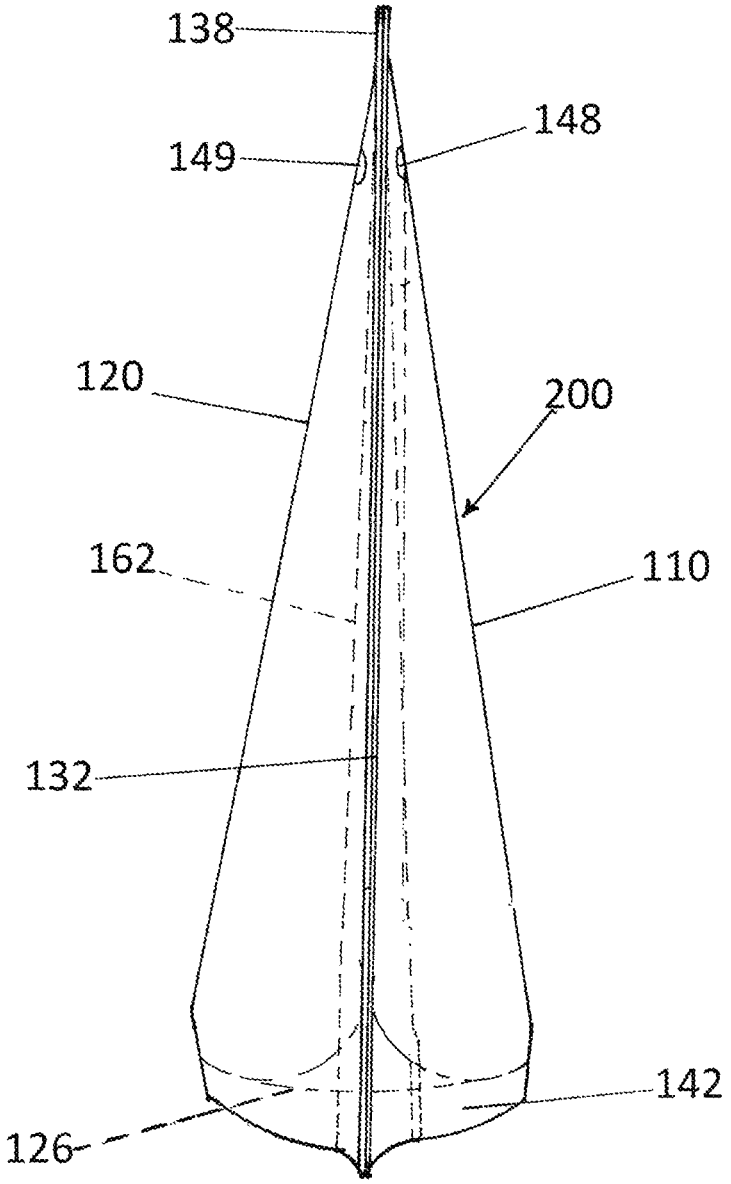
FIG. 7 is a side view, of an exemplary alternate embodiment pouch of the present invention.

FIG. 5 is a rear perspective view that illustrates the internal construction of the pouch 100. The back panel 120 is a substantially planar sheet. The front panel 110 is connected to or formed with a right folded panel 160 and a left folded panel 162. The folded panels each include a respective port 148*a*, 150*a* that are in registry with the respective ports 148, 150. The ports 148*a*, 150*a* can be circular areas that have weakened perimeters, such that a straw forced through the port 148 will also penetrate through the port 148*a*, and a straw penetrating the port 150 would also penetrate through the port 150*a*. The front panel 110 and the folded panels 160, 162 are sealed together around the respective port pairs 148, 148*a* and 150, 150*a* to prevent a straw penetrating the outside port 148, 150 but not penetrating the inside port 148*a*, 150*a* respectively and instead the straw penetrating between the front panel 110 and the respective folded panel 160, 162.

The right folded panel 160 is sealed along a top edge band 138*a* thereof to the top seal band 138 of the pouch, and sealed at a bottom edge band 142*a* thereof to the surrounding bottom seal band 142 of the pouch. The left folded panel 162 is sealed along a top edge seal band 138*b* to the top seal band 138 of the pouch, and sealed at a bottom seal band 142*b* thereof to the surrounding bottom seal band 142 of the pouch. The right folded panel 160 has a front vertical seal band 134*a* that is sealed with the right vertical seal band 134 of the pouch, and a back vertical seal band 134*b* that is sealed to the right vertical seal band 134 of the pouch. The left folded edge panel 162 has a front vertical seal band 132*a* that is sealed with the left vertical seal band 132 of the pouch, and a back vertical seal band 132*b* that is sealed to the left vertical seal band 132 of the pouch.

Once the pouch is formed and all seal bands are sealed, the right folded panel 160 forms a right side chamber 164 and the left folded panel forms a left side chamber 166. The pouch between the right side chamber 164 and the left side chamber 166 forms a central chamber 168. The right side chamber 164 is substantially sealed. A straw penetrating the ports 150, 150*a* will not have access to the contents of the central chamber 168. The left folded panel 162 includes an aperture 170 near to a bottom thereof. When the seals of the pouch are sealed, the left side chamber 166 will be in communication with the contents of the central chamber 168 through the aperture 170. A straw penetrating the ports 148, 148*a* will deliver beverage from the central chamber 168 into the left side chamber 166 and out the straw.

As shown in FIG. 1, a label 250 is applied to the pouch 100 with a question 252 and two answer choices "A" and "B". The answer choice "A" corresponds to the port 148 and the answer choice "B" corresponds to the port 150. According to the illustrated embodiment, answer choice "A" would be the correct answer to the question and corresponds to the "primary" opening, and a straw pushed through port 148 would deliver liquid from the central chamber 168 through the aperture 170 and into the chamber 166 would deliver beverage to the user sipping through the straw. The answer choice "B" would be the incorrect answer and corresponds to the "secondary" opening, and a straw pushed through the port 150 would access the closed chamber 164 and no liquid would be delivered through the straw. The manufacturing of the pouch would assure that the correct answer would alternately be "A" or "B" requiring the user to make a correct selection to access an open channel. In other words, the aperture would be placed in either chamber 164, 166 and would correspond to the correct answer "A" or FIGS. 7-10 show a modified, alternate embodiment pouch 200 to that shown in FIGS. 1-6. Like items between the two embodiments are given the same reference numbers.

The pouch 200 comprises the front panel 110, the back panel 120 and the floor panel 126. The front panel 110, the back panel 120 and the floor panel 126 may be of a multi-layer construction as is known for flexible pouches containing a beverage. The front panel and the back panel are sealed together along the vertical seal bands 132, 134 and across the top seal band 138. The front and back panels 110, 120 are sealed along inside bottom bands, forming the continuous band 142 all around to the floor panel 126.

On the front panel, near the top, are two ports, the left front port 148 and the right front port 150. The back panel 120 includes a right back port 151 and a left back port 149. The ports 148, 150, 149, 151 are circular and can be areas with weakened perimeters that allow for a straw to be forcefully inserted into the pouch through the respective panel.

Figure 9:
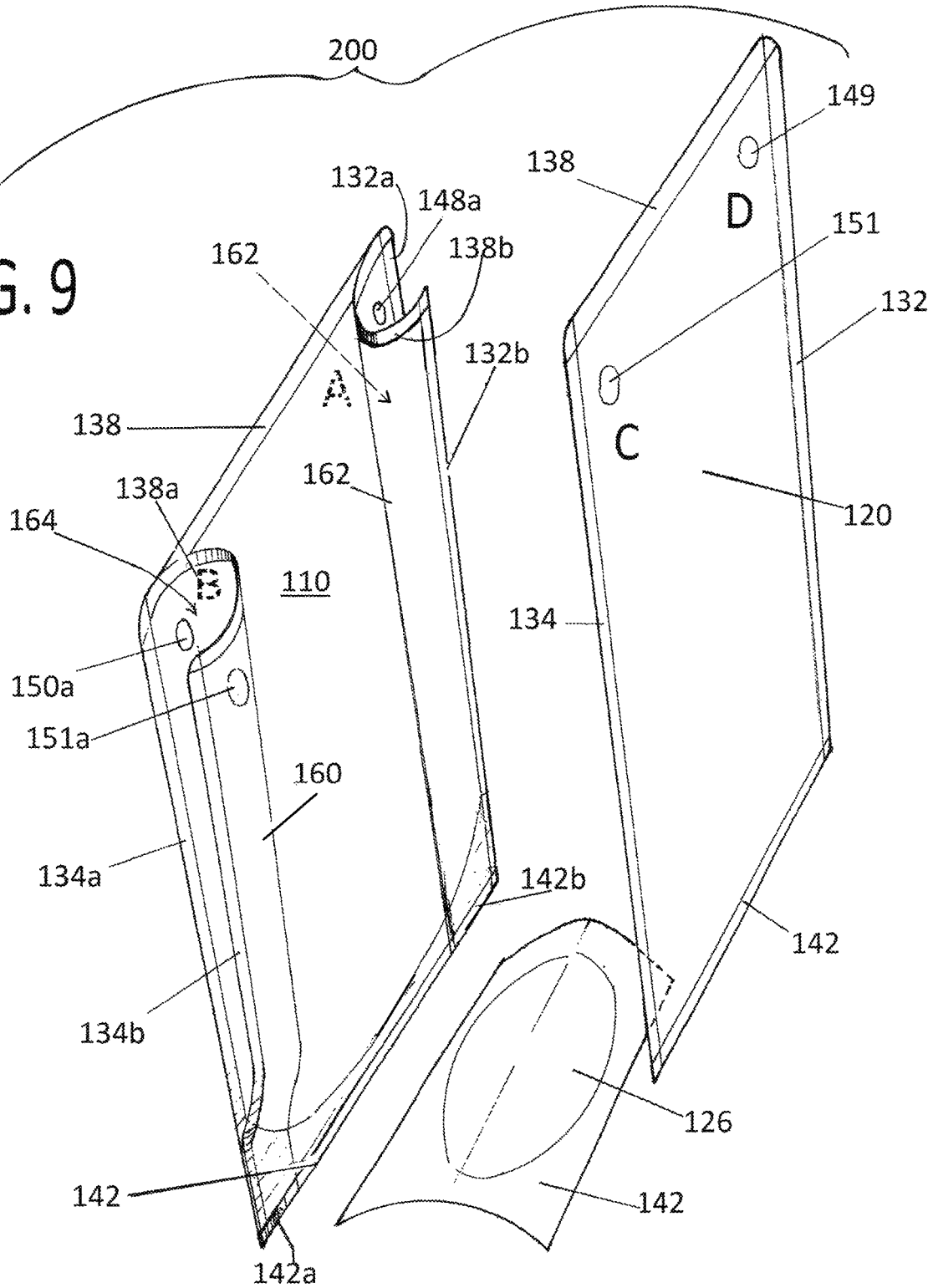
FIG. 9 is a rear exploded perspective view of the pouch of FIG. 7, before a front panel, a back panel, and a floor are sealed together.
Figure 10:
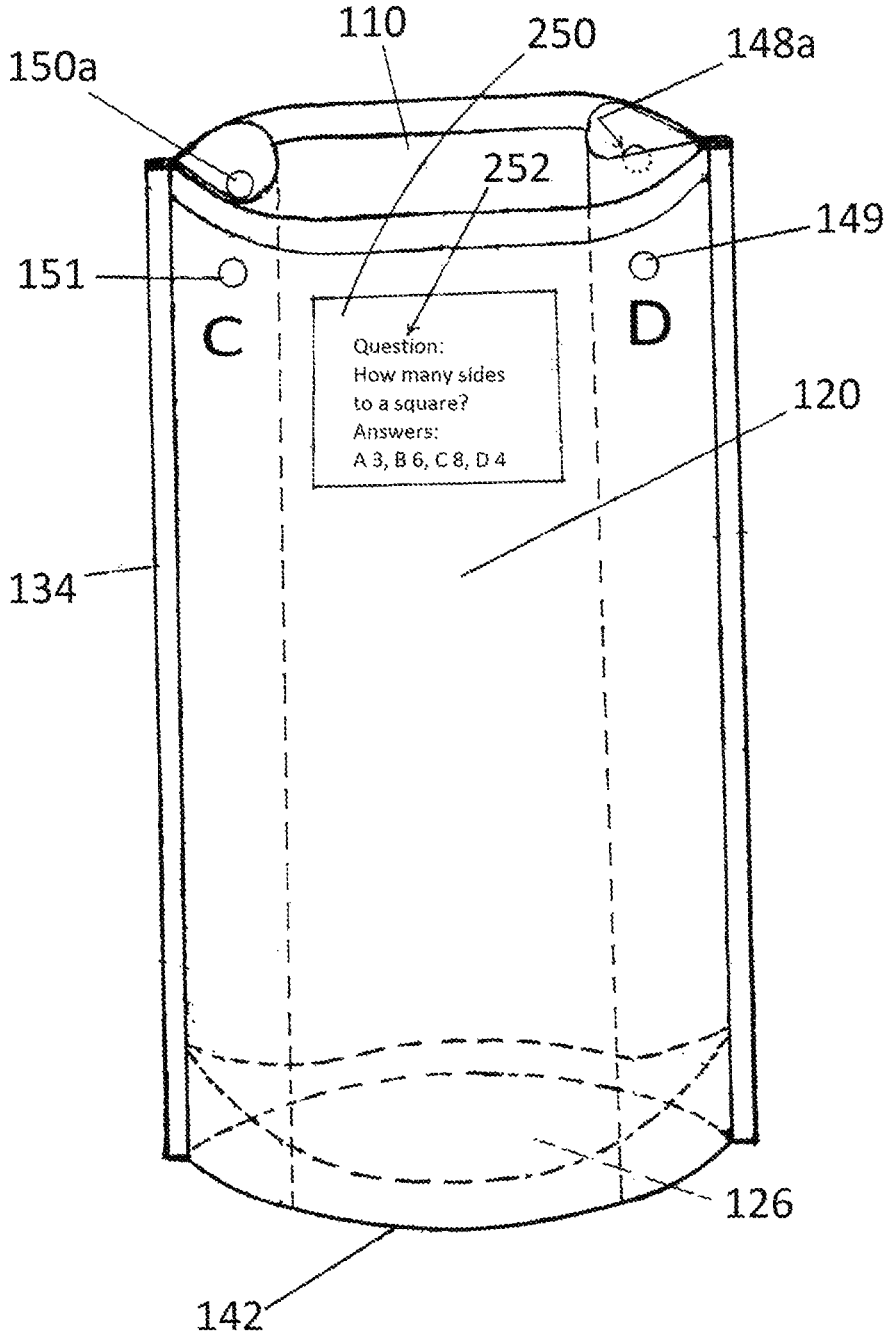
FIG. 10 is a rear perspective view of the pouch of FIG. 9 with the front panel, the back panel, and the floor sealed, except for the top edge of the front and back panels.

FIG. 9 illustrates the internal construction of the pouch 200. The back panel 120 is a substantially planar sheet. The front panel 110 is connected to, or formed with, the right folded panel 160 and the left folded panel 162. The folded panels 160, 162 include the respective port 150*a*, 148*a* and the right back panel includes a port 151*a*. The port 148*a* and the port 150*a* are in registry with the front ports 148, 150 respectively, and the port 151*a* is in registry with the right back port 151. The ports 148*a*, 150*a* can be circular areas that have weakened perimeters, such that a straw forced through the port 148 will also penetrate through the port 148*a*, a straw penetrating the port 150 would also penetrate through the port 150*a*, and a straw penetrating the back port 151 would also penetrate the front port 151*a*. The front panel 110 and the folded panels 160, 162 are sealed together around the respective port pairs 148, 148*a* and 150, 150*a* and the back panel 120 and the folded panel 160 are sealed around the port pair 151, 151*a*, to prevent a straw penetrating the outside port 148, 150,151 but not penetrating the respective inside port 148*a*, 150*a*, 151*a*, and instead the straw penetrating between the front panel 110 and the respective folded panel 160, 162 or the back panel 120 and the folded panel 160.

The right folded panel 160 is sealed along the top edge band 138*a* thereof to the top seal band 138 of the pouch, and sealed at the bottom edge band 142*a* thereof to the surrounding bottom seal band 142 of the pouch. The left folded panel 162 is sealed along a top edge seal band 138*b* to the top seal band 138 of the pouch, and sealed at a bottom seal band 142*b* thereof to the surrounding bottom seal band 142 of the pouch. The right folded panel 160 having the front vertical seal band 134*a* is sealed with the right vertical seal band 134 of the pouch, and the back vertical seal band 134*b* is sealed to the right vertical seal band 134 of the pouch. The left folded edge panel 162 having the front vertical seal band 132*a* is sealed with the left vertical seal band 132 of the pouch, and the back vertical seal band 132*b* is sealed to the left vertical seal band 132 of the pouch.

Once the pouch is formed and all seal bands are sealed, the right folded panel 160 forms the right side chamber 164 and the left folded panel forms the left side chamber 166. The pouch between the right side chamber 164 and the left side chamber 166 forms the central chamber 168. The right side chamber 164 is substantially sealed. A straw penetrating the port 150 or the port 151 will not have access to the contents of the central chamber 168. The left folded panel 162 in this embodiment is also substantially sealed and has no bottom aperture (such as the aperture 170 of the embodiment of FIGS. 1-3). When the seals of the pouch are sealed neither the left side chamber 166 nor the right chamber 164 will be in communication with the contents of the central chamber 168. A straw penetrating the port 148 will access the chamber 166. However, a straw penetrating the left back port 149 will not penetrate the left chamber 166, the port 149 having no inside port in registry with the left back port 149, and will communicate directly into the central chamber 168, which will deliver beverage from the central chamber 168 and out the straw.

The label 250 is applied to the pouch 200 with the question 252 and four answers, choices "A", "B", "C" and "D". The answer choice "A" corresponds to the port 148, the answer choice "B" corresponds to the port 150, the answer choice "C" corresponds to the port 151 and the answer choice D corresponds to the port 149. According to the illustrated embodiment, answer choice "D" would be the correct answer to the question and corresponds to the "primary" opening, and a straw pushed through port 149 would deliver beverage from the central chamber 168 to the user sipping through the straw. The answer choices "B" and "C" would be the incorrect answer and corresponds to "secondary" openings, and a straw pushed through the port 150 or the port 151 would access the closed chamber 164 and no liquid would be delivered through the straw. The answer choice "A" would also be the incorrect answer and also corresponds to a "secondary" opening, and a straw pushed through the port 148 would access the closed chamber 166 and no liquid would be delivered through the straw. The manufacturing of the pouch would assure that the correct answer would alternately be "A", "B", "C" or "D" requiring the user to make a correct selection to access the central chamber 168.

Although the exemplary embodiment can be advantageously configured for the game or educational purpose, it is also encompassed by the invention that a multi-chamber pouch is provided that can have different chambers holding different products, liquid or solid.

As an alternate to the label 250, an electronically readable tag, such as a bar code, can be used that can be scanned by an electronic device that reveals the question and answer choices. The tag may be of any suitable configuration to be scanned by a device, such as a traditional bar code, a QR code, or any similar representation.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A multi-chamber pouch, comprising:

a pouch having a front panel, a back panel and a floor panel;

a left interior folded panel and a right interior folded panel arranged alongside lateral edges of the front panel and back panel and sealed thererto and to the floor panel, the left folded panel and the right folded panel forming a left side chamber and a right side chamber respectively within the pouch, a central chamber substantially between the left side chamber and the right side chamber, wherein at least the right side chamber is sealed from the central chamber;

the front panel having a left front port and a right front port, wherein the left front port and the right front port comprise areas with defined perimeters to indicate a location for a straw to penetrate through the front panel, wherein a straw penetrated into the left front port will communicate into the central chamber and a straw penetrating the right front port will enter the right side chamber; and an indication near to each of the right port and the left port that associates each port with a selectable answer to a quiz question.

2. The multi-chamber pouch according to claim 1 wherein the left side chamber has an opening into the central chamber and a straw penetrating the left side chamber communicates into the central chamber.

3. The multi-chamber pouch according to claim 2, wherein the front panel, the back panel and the floor panel are of multi-layer construction.

4. The multi-chamber pouch according to claim 2, wherein the front panel and the back panel are sealed together along vertical seal bands and across a top seal band and the front and back panels are sealed along inside bottom bands, forming a continuous band all around to the floor panel.

5. The multi-chamber pouch according to claim 4, wherein the front panel is connected to or formed with a right folded panel to form the right side chamber and a left folded panel to form the left side chamber, the folded panels each include a left side panel port and a right side panel port that are in registry with the respective left front port and right front port, wherein a straw forced through the left front port 148 will also penetrate through the left panel port, and a straw penetrating the right front port 150 would also penetrate through the right side panel port.

6. The multi-chamber pouch according to claim 1 wherein both the left side chamber and the right side chamber are sealed from the central chamber and the front panel having a left front port and a right front port, the back panel having a left back port and a right back port, wherein the left front port, the right front port, the left back port and the right back port comprise areas with defined perimeters to indicate a location for a straw to penetrate through the front panel or the rear panel respectively, wherein a straw penetrated into the left front port or the left back port enters the left side chamber, and wherein a straw penetrated into the right back port enters the right side chamber, wherein a straw penetrated into the right front port enters the central chamber;

an indication near to each of the right front port, the left front port, the right back port and the left back port that associates each port with a selectable answer to a quiz question.

7. A multi-chamber pouch, comprising:

a pouch having a front panel, a back panel and a floor panel;

a left interior folded panel and a right interior folded panel arranged alongside lateral edges of the front panel and the back panel and sealed thererto and to the floor panel, the left folded panel and the right folded panel forming a left side chamber and a right side chamber within the pouch, a central chamber between the left side chamber and the right side chamber, wherein neither the left side chamber nor the right side chamber is in fluid communication with the central chamber;

the front panel having a left front port and a right front port, the back panel having a left back port and a right back port, wherein the left front port, the right front port, the left back port and the right back port comprise areas with defined perimeters to indicate a location for a straw to penetrate through the front panel or the rear panel respectively, wherein a straw penetrated into the left front port or the left back port enters the left side chamber, and wherein a straw penetrated into the right back port enters the right side chamber, wherein a straw penetrated into the right front port enters the central chamber;

an indication near to each of the right front port, the left front port, the right back port and the left back port that associates each port with a selectable answer to a quiz question.

* * * * *